US009763310B2

(12) United States Patent
Dahlen

(10) Patent No.: US 9,763,310 B2
(45) Date of Patent: Sep. 12, 2017

(54) SYSTEMS AND METHODS FOR COMMISSIONING A LIGHTING SYSTEM

(71) Applicant: KENALL MANUFACTURING COMPANY, Gurnee, IL (US)

(72) Inventor: Kevin Dahlen, Lindenhurst, IL (US)

(73) Assignee: KENALL MANUFACTURING COMPANY, Kenosha, WI (US)

( * ) Notice: Subject to any disclaimer, the term of this patent is extended or adjusted under 35 U.S.C. 154(b) by 168 days.

(21) Appl. No.: 14/069,818

(22) Filed: Nov. 1, 2013

(65) Prior Publication Data

US 2015/0123563 A1 May 7, 2015

(51) Int. Cl.
*H05B 37/02* (2006.01)

(52) U.S. Cl.
CPC ..... *H05B 37/0245* (2013.01); *H05B 37/0272* (2013.01)

(58) Field of Classification Search
CPC ..... H05B 37/0245; H05B 37/0272; H05B 37/0227; H05B 37/0218; H05B 37/0254; H05B 33/0845; H05B 37/02
USPC ..... 345/156; 315/224, 291, 247, 152, 201; 362/252, 249, 231
See application file for complete search history.

(56) References Cited

U.S. PATENT DOCUMENTS

| | | | | |
|---|---|---|---|---|
| 7,508,787 | B2 | 3/2009 | Doshi et al. | |
| 7,761,260 | B2 | 7/2010 | Walters et al. | |
| 8,111,018 | B2 | 2/2012 | You | |
| 8,248,963 | B2 | 8/2012 | Kim et al. | |
| 8,742,686 | B2 * | 6/2014 | Zampini et al. | 315/297 |
| 8,742,694 | B2 * | 6/2014 | Bora | H05B 33/0863 315/113 |
| 9,155,165 | B2 * | 10/2015 | Chobot | H05B 37/0209 |
| 2004/0105261 | A1 * | 6/2004 | Ducharme et al. | 362/231 |
| 2007/0022581 | A1 | 2/2007 | Hsieh | |
| 2008/0147337 | A1 | 6/2008 | Walters et al. | |
| 2008/0265799 | A1 * | 10/2008 | Sibert | 315/292 |

(Continued)

FOREIGN PATENT DOCUMENTS

| | | | |
|---|---|---|---|
| WO | WO-2009129232 | A1 | 10/2009 |
| WO | WO-2009137041 | A1 | 11/2009 |
| WO | WO-2011106868 | A1 | 9/2011 |

OTHER PUBLICATIONS

Werb et al., The Practical Engineer, pp. 71-78, IEEE Spectrum, Sep. 1998.

(Continued)

*Primary Examiner* — Douglas W Owens
*Assistant Examiner* — Wei Chan
(74) *Attorney, Agent, or Firm* — Marshall, Gerstein & Borun LLP; Randall G. Rueth

(57) ABSTRACT

Embodiments are provided for commissioning a lighting system that includes a plurality of luminaires. According to certain aspects, an electronic device can, for each of the plurality of luminaires, connect to a luminaire and retrieve an identification of the luminaire. The electronic device can associate its location as the location of the luminaire, as well as prompt a user to associate a layout tag of existing layout data for the lighting system with the luminaire. The electronic device can transmit the commissioning data for the lighting system to a server for remote storage. The server enables remote access to the commissioning data by various electronic devices and users thereof.

12 Claims, 6 Drawing Sheets

(56) References Cited

U.S. PATENT DOCUMENTS

| | | | | |
|---|---|---|---|---|
| 2009/0066258 | A1* | 3/2009 | Cleland | H02J 3/14 315/158 |
| 2009/0225658 | A1 | 9/2009 | Rezvani et al. | |
| 2010/0159971 | A1 | 6/2010 | Herscovich et al. | |
| 2010/0301769 | A1 | 12/2010 | Chemel et al. | |
| 2012/0235579 | A1* | 9/2012 | Chemel et al. | 315/152 |
| 2012/0306621 | A1 | 12/2012 | Muthu | |
| 2013/0015783 | A1* | 1/2013 | Herbst | H05B 37/0245 315/297 |
| 2013/0026945 | A1* | 1/2013 | Ganick | H05B 37/0272 315/246 |
| 2013/0057158 | A1 | 3/2013 | Josefowicz et al. | |
| 2013/0088168 | A1* | 4/2013 | Mohan | G05B 15/02 315/297 |
| 2013/0181609 | A1* | 7/2013 | Agrawal | H05B 37/03 315/131 |
| 2014/0070706 | A1* | 3/2014 | Fushimi | H05B 33/0863 315/131 |
| 2014/0184100 | A1* | 7/2014 | Yamada | H05B 37/0245 315/297 |

OTHER PUBLICATIONS

Bulusu et al., GPS-less Low Cost Outdoor Localization for Very Small Devices, IEEE Personal Communication Magazine, pp. 1-7, Oct. 2000.

Capkun et al., GPS-free positioning in mobile ad hoc networks; 2001 pp. 1-15.

Ssu et al., Localization with Mobile Anchor Points in Wireless Sensor Networks, pp. 1187-1197, IEE Transaction on Vehicular Technology, vol. 54, No. 3, May 2005.

Hu et al., Localization in Wireless Sensor Networks Using a Mobile Anchor Node, pp. 1-9, http//www.paper.edu.cn.

Nagpal et al., Organizing a Global Coordinate System from Local Information on an Ad Hoc Sensor Network; pp. 1-16.

Kastner et al., Communication Systems for Building Automation and Control, pp. 1178-1203, Proceedings of the IEEE, vol. 93, No. 6, Jun. 2005.

Lu et al., Creating Robust Activity Maps Using Wireless Sensor Network in a Smart Home, pp. 741-746, IEEE Conference on Automation Science and Engineering, Sep. 22-25, 2007.

Valle et al., Mesh Topology Viewer (MTV); an SVG-Based Interactive Mesh Network Topology Visualization Tool; p. 1-6.

Planning/Installation/Monitoring Guide for Mesh Networks, NetEquality Equal Access Community Internet; www.netequality.org/docs/ <http://www.netequality.org/docs/>; pp. 1-11.

HotViewTM; Mesh Management System; www.firetide.com <http://www.firetide.com>; p. 1-5; © Firetide, Inc.

Duarte et al., Management Issues on Wireless Mesh Networks; p. 1-12.

Setup Guide Meraki Outdoor; Part No. 280-03100; p. 1-2.

Wireless Mess Networking Technology/Wifi Mesh Network by Meraki; © 2007 Meraki Networks, Inc.; web.archive.org/web/20071104002330/http://meraki.cm/oursolution/mesh/.

Gomez et al., Wireless Home Automation Networks: A Survey of Architectures and Technologies; IEEE Communications Magazine, Jun. 2010.

Perez et al.; Low-rate wireless personal area network applied to street lighting; Lighting Research and Technology Dec. 14, 2011; lrt.sagepub.com/content/early/2011/11/24/1477153511431129.abstract. Retrieved from Internet on: Jun. 25, 2013.

Bellido-Outeirino et al., Building Lighting Automation through the Integration of DALI with Wireless Sensor Networks, pp. 47-52, IEEE Transactions on Consumer Electronics, vol. 58, No. 1, Feb. 2012.

Philips, Mini300 LED gen2, sensor manual, Version date: Jul. 25, 2013. <http://www.lighting.philips.com/pwc_li/main/shared/assets/images/connect/mini300/Mini300-LED-gen2-sensor-manual.pdf>, retrieved on Feb. 3, 2014.

* cited by examiner

SYSTEMS AND METHODS FOR COMMISSIONING A LIGHTING SYSTEM

FIELD

This application generally relates to commissioning a lighting system. In particular, the application relates to platforms and techniques for commissioning a lighting system using an electronic device and a server, as well as leveraging the server to access the lighting system.

BACKGROUND

Most commercial buildings, parking structures, transportation areas or structures, and the like are equipped with lighting systems that typically include several luminaires or light fixtures. For a lighting system to operate in accordance with the intended design or operational needs, the lighting system must be properly commissioned. Commissioning a lighting system can be a tedious process that requires numerous hardware components as well as proper installation of luminaires, as well as the cooperation among owners, designers, contractors, facility managers, building staffs, and/or commissioning agents. Additionally, controllers associated with computer-based lighting systems must be properly connected to and configured with the luminaires.

Current software and techniques used in commissioning most computer-based lighting controls are difficult to use, inadequate, and sometimes beyond the skill set of the individuals that are tasked with commissioning the lighting system. Additionally, the luminaires themselves often include numerous hardware components that result in increased manufacturing costs. Further, a commissioned lighting system requires on-site hardware and storage that is vulnerable to damage, security breaches, and data loss.

Accordingly, there is an opportunity to implement embodiments for effectively and efficiently commissioning a lighting system. Additionally, there is an opportunity to implement embodiments for enabling convenient access to lighting system data.

SUMMARY

In an embodiment, a method of commissioning a lighting system is provided. The method comprises connecting, using an electronic device, to a luminaire via a short range communication, and receiving, from the luminaire via the short range communication, an identification of the luminaire. The method further comprises identifying a location of the electronic device, associating, by a processor of the electronic device, the identification of the luminaire with the location, and sending the identification of the luminaire and the location that were associated to a server via a network connection.

In another embodiment, an electronic device for commissioning a lighting system is provided. The electronic device comprises a communication module and a memory for storing a set of non-transitory computer-readable instructions. The electronic device further includes a processor coupled to the communication module and the memory, and configured to execute the set of non-transitory computer-readable instructions to connect to a luminaire via a short range communication, and receive, from the luminaire via the short range communication, an identification of the luminaire. The processor is further configured to execute the set of non-transitory computer-readable instructions to identify a location of the electronic device, associate the identification of the luminaire with the location, and send, to a server using the communication module, the identification of the luminaire and the location that were associated.

BRIEF DESCRIPTION OF THE DRAWINGS

The accompanying figures, where like reference numerals refer to identical or functionally similar elements throughout the separate views, together with the detailed description below, are incorporated in and form part of the specification, and serve to further illustrate embodiments of concepts that include the claimed embodiments, and explain various principles and advantages of those embodiments.

DETAILED DESCRIPTION

Figure 1:
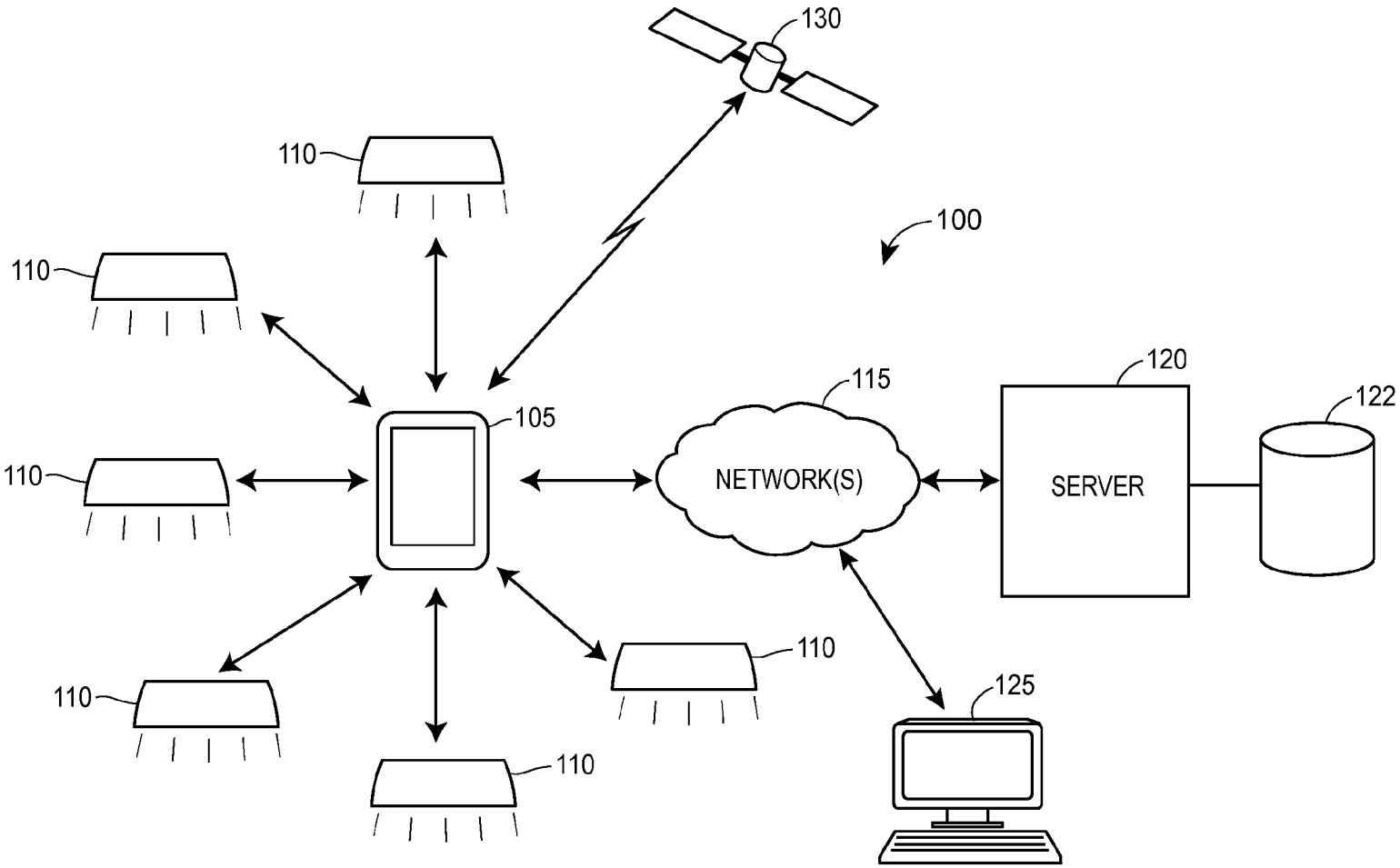
FIG. 1 depicts an example representation of an environment and components thereof for commissioning and accessing a lighting system.

The novel methods and systems disclosed herein generally relate to commissioning a lighting system and enabling access to data relating thereto. According to embodiments, a user can use an electronic device to connect to one or more luminaires that are already physically installed in or on the building, structure, or the like that supports the lighting system. The electronic device can store or otherwise have access to layout data that indicates intended locations or positions for the luminaires. Upon connecting to the electronic device, the luminaires can send corresponding unique identifiers, such as media access control (MAC) addresses, to the electronic device. In embodiments, the electronic device can, for each of the luminaires, identify its location and associate the identified location as the location of the luminaire. According to some embodiments, a user of the electronic device can position the electronic under, near, or otherwise in proximity to the luminaire so as to accurately associate the location of the electronic device as the location of the luminaire. The electronic device can further associate the location with the unique identifier of the luminaire.

Additionally, the electronic device can prompt the user with an indication of a layout tag from the layout data that corresponds to a given luminaire. The user can select to associate a unique identifier and location pair for the given luminaire with the layout tag. In particular, the user can examine the layout data to gauge an appropriate luminaire to select based on the user's positioning in relation to the luminaire, which is also the luminaire that the electronic device has connected to and with which the electronic device has associated its location. The electronic device can connect to each luminaire of the lighting system individually to retrieve respective unique identifiers, as well as identify a location for each luminaire.

According to embodiments, the electronic device can send the identification and location data for each luminaire to a server via a network connection. Upon retrieval of the commissioning data, the server can store the commissioning data and enable access to the commissioning data. For example, an additional electronic device can connect to the remote server and request access to the commissioning data, the layout data, and/or any data associated with the lighting system.

The systems and methods as discussed herein offer numerous advantages over existing lighting commissioning systems. In particular, because the server and storage thereof can be located remotely or in the "cloud," an administrator associated with the lighting system need not configure or rely on local storage for commissioning a lighting system or storing system data associated therewith. Further, the server can enable a third party or additional device remote from the lighting system to access the lighting system information, thereby increasing the number of access channels to the system data. Additionally, as a result of the electronic device obtaining its own location and associating its location as the location of respective luminaires, the luminaires need not include a GPS receiver, thereby reducing the production costs of the luminaires. It should be appreciated that additional advantages and benefits are envisioned.

FIG. 1 is an example representation of an environment 100 and components thereof for commissioning and accessing a lighting system. As shown in FIG. 1, the environment 100 includes an electronic device 105 and a plurality of luminaires 110. The electronic device 105 may be, for example, a handheld wireless device, a mobile phone, a Personal Digital Assistant (PDA), a smart phone, a tablet or laptop computer, a multimedia player, an MP3 player, a digital broadcast receiver, a remote controller, or any other electronic apparatus. Each of the plurality of luminaires 110 may be any type of light fixture, light fitting, or other device used to create light by use of an electric lamp, and may include a fixture body and a light socket to hold the lamp and allow for a replacement lamp. It should be appreciated that the plurality of luminaires 110 need not be uniform (i.e., the plurality of luminaires 110 can be of different types, sizes, model numbers, etc.). According to some embodiments, the plurality of luminaires 110 can collectively be associated with a lighting system or a portion thereof. For example, the lighting system can be included in a parking garage (or a floor or section of the parking garage), commercial building (or a portion thereof), roadway or other transportation structure (or a portion thereof), residential home or building, or other indoor or outdoor space or environment. Although not shown in FIG. 1, it should be appreciated that the plurality of luminaires 110 may connect to each other via a wired or wireless connection (such as to form a mesh network). Further, it should be appreciated that the plurality of luminaires 110 may connect to and, once commissioned, be controlled by a central controller or similar device or component.

According to embodiments, the electronic device 105 can be configured to initiate a commissioning of the plurality of luminaires 110. For example, a user of the electronic device 105 can initiate an application adapted to facilitate the commissioning functionalities as discussed herein. It should be appreciated that other techniques to initiate the commissioning of the lighting system are envisioned. The electronic device 105 can access, retrieve, or otherwise store layout information associated with the plurality of luminaires 110 and the associated lighting system. In particular, the layout information can include a set of unique tags, addresses, or the like (hereinafter, "layout tags"), each of which is to be associated with one of the plurality of luminaires 110. The layout information can further be depicted as a graphical rendering of the layout of the lighting system as well as approximate locations of where luminaires are installed or are to be installed. For example, if the lighting system is associated with a floor of a parking garage, then the layout data can indicate layout tags for luminaires such as FL1LUM1, FL1LUM2, FL1LUM3, etc., and the layout information can also graphically approximate the locations of the luminaires. It should be appreciated that various naming and numbering conventions for the layout tags are envisioned. In some cases before commissioning the plurality of luminaires 110, the layout tags of the layout information are not yet associated with the plurality of luminaires 110, whereby commissioning the plurality of luminaires 110 associates them with the layout information and the layout tags thereof. According to some embodiments, the electronic device 105 can have the layout information preloaded into memory. According to other embodiments, the electronic device 105 can retrieve the layout information from a third-party source.

Referring to FIG. 1, the electronic device 105 can be configured to connect (e.g., using one or more communication modules) to each of the plurality of luminaires 110 via a short range communication to retrieve various data. In particular, in response to the electronic device 105 connecting to one of the plurality of luminaires 110, the corresponding luminaire can send a unique identifier, such as its media access control address (MAC address), to the electronic device 105. It should be appreciated that other unique identifiers or identifications are envisioned. In embodiments, the short range communication can be radio-frequency identification (RFID), Bluetooth®, Bluetooth® low energy (BLE), Infrared Data Association (IrDA), near field communication (NFC), ZigBee, other protocols defined under the IEEE 802 standard, and/or other technologies.

As shown in FIG. 1, the electronic device 105 is further configured to connect (e.g., using one or more communication modules) to a satellite 130, such as a global positioning system (GPS) satellite, to identify its location. In particular, the electronic device 105 can be equipped with a GPS receiver to retrieve its GPS coordinates from the satellite 130. According to embodiments, a user of the electronic device 105 can position the electronic device 105 near, under, or otherwise in a general proximity to the corresponding luminaire 110 and can select to have the electronic device 105 identify its location (e.g., using a GPS receiver) when at this position. Accordingly, the electronic device 105 can associate its location with a location of the corresponding luminaire 110 (i.e., the location of the electronic device 105 can represent the location of the corresponding luminaire 110). It should be appreciated that the electronic device 105 can identify its location via other techniques, such as cellular tower triangulation, Wi-Fi positioning, or others.

The electronic device 105 can be configured to, for each of the plurality of luminaires 110, associate the unique identifier or identification of the luminaire with the location of the electronic device 105 whereby each of the plurality of luminaires 110 may have a different location (e.g., as a result of the user of the electronic device 105 positioning the electronic device 105 within a proximity of the corresponding luminaire 110). In some cases, the electronic device 105 can generate a data record for each of the plurality of luminaires 110, whereby the data record includes the unique identifier for the luminaire and the location associated with the luminaire. It should be appreciated that the electronic device 105 can use other techniques to pair or associate the unique identifier and the location for each of the plurality of luminaires 110.

The electronic device 105 can further be configured to associate each of the plurality of luminaires 110, as well as the identification and location data of the luminaire, with a layout tag specified in the layout information. In operation, a user of the electronic device 105 can select to associate a specific layout tag with a location and identification of a corresponding luminaire. For example, the user can use a graphical user interface (GUI) to select a layout tag "FL1LUM1" displayed in layout information, whereby selecting the layout tag can associate the layout tag with location and identification data of a corresponding luminaire. It should be appreciated that other techniques are envisioned for associating a layout tag with identification and location information of a luminaire. Accordingly, each of the plurality of luminaires 110 can have at least three associated pieces of data or information: its unique identifier, location, and corresponding layout tag.

As shown in FIG. 1, the electronic device 105 can be configured to connect (e.g., using various communication modules) to a server 120 via one or more networks 115 such as, for example, a wide area network (WAN), a local area network (LAN), a personal area network (PAN), or other networks. The network 115 can facilitate any type of data communication via any standard or technology (e.g., GSM, CDMA, TDMA, WCDMA, LTE, EDGE, OFDM, GPRS, EV-DO, UWB, IEEE 802 including Ethernet, WiMAX, WiFi, Bluetooth®, and others). The server 120 can be located remotely (e.g., in the "cloud") from the electronic device 105 and the plurality of luminaires 110, and can include any combination of hardware and software configured to receive, store, and process data, as well as facilitate any of the functionalities as discussed herein. In some embodiments, the electronic device 105 can retrieve various layout data (and layout tag information thereof) from the server 120.

According to embodiments, the electronic device 105 can send data associated with the plurality of luminaires 110, for example the location data, identification data, and layout tag association, to the server 120. In some cases, the electronic device 105 can send the collective data for at least two of the plurality of luminaires 110 to the server 120 at the same time. In other cases, the electronic device 105 can send data for individual luminaires 110 at multiple distinct times. The server 120 can, upon receipt of the data associated with the plurality of luminaires 110, store the associated information or data in a local or remote database 122, or in other storage.

As shown in FIG. 1, an additional electronic device 125 can be configured to connect to the server 120 via the network 115. The additional electronic device 125 may be, for example, a desktop computer, a laptop computer, a handheld wireless device, such as a mobile phone, a Personal Digital Assistant (PDA), a smart phone, a multimedia player, an MP3 player, a digital broadcast receiver, a remote controller, or any other electronic apparatus. According to embodiments, the additional electronic device 125 can request the server 120 for the information associated with the lighting system and the plurality of luminaires 110 thereof. For example, the additional electronic device 125 can request layout information of the lighting system that includes locations, identifications, and layout tags for the plurality of luminaires 110. The server 120 can provide the requested information to the additional electronic device 125 which can be configured to present, for example via a graphical user interface (GUI), the layout data and the information associated therewith (e.g., the unique identifiers and the location data of the plurality of luminaires 110 and the layout tags). Accordingly, a user of the additional electronic device 125 can access the information to effectively and efficiently gauge information associated with the lighting system. In some embodiments, the electronic device 125 can retrieve additional information from the server 120, for example status information related to the luminaires of the lighting system, such as operating status, hardware information, driver status, temperature, operating hours, power consumption, layout tag, and/or other data.

Figure 2:
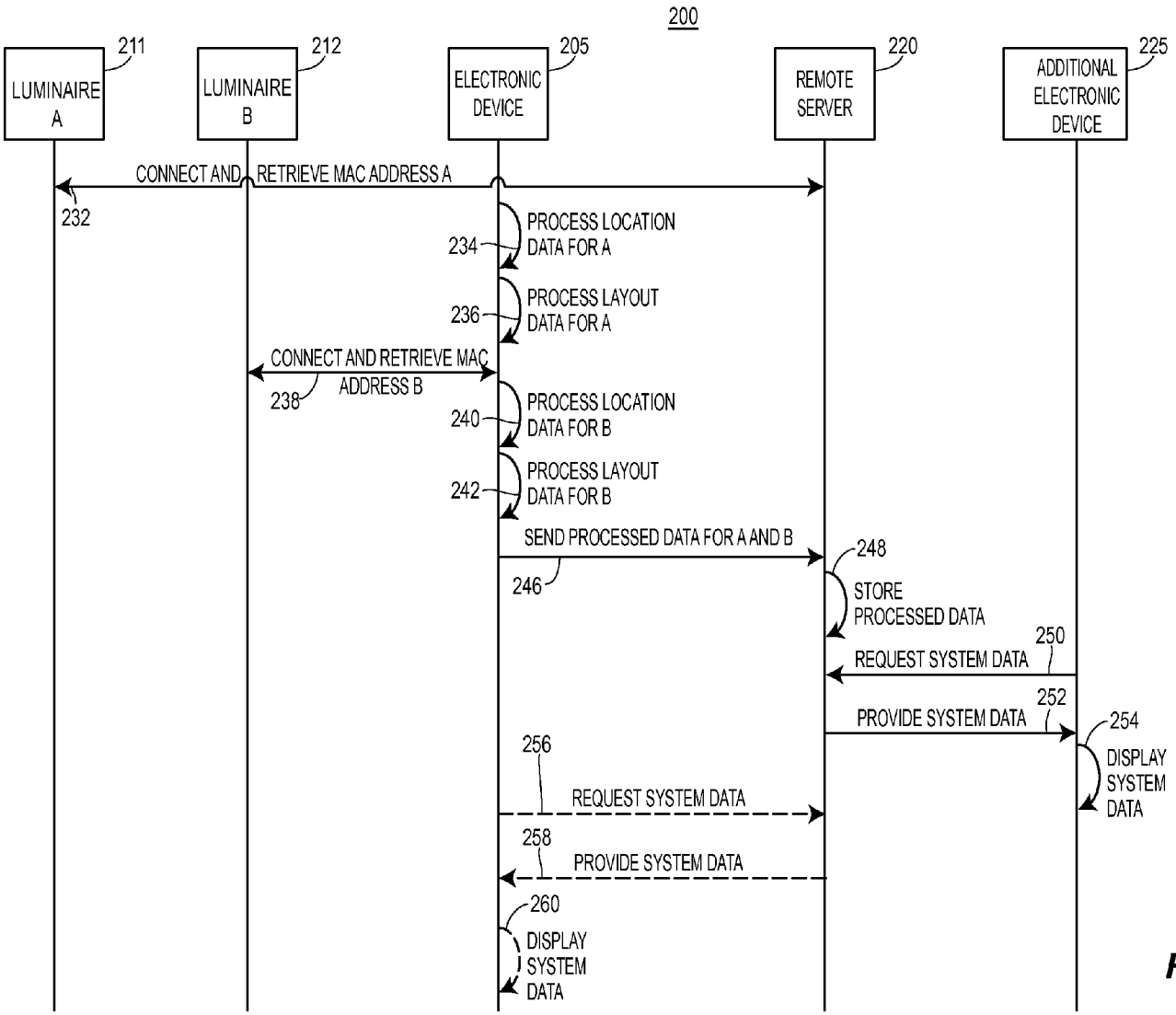
FIG. 2 depicts an example diagram associated with commissioning a lighting system and accessing data thereof in accordance with some embodiments.

Referring to FIG. 2, depicted is a diagram 200 illustrating techniques for commissioning a lighting system. In particular, the diagram 200 includes luminaire A 211 (such as one of the luminaires 110 as described with respect to FIG. 1), luminaire B 212 (such as one of the luminaires 110 as described with respect to FIG. 1), an electronic device 206 (such as the electronic device 105 as discussed with respect to FIG. 1), a remote server 220 (such as the server 120 as discussed with respect to FIG. 1), and an additional electronic device 225 (such as the additional electronic device 125 as discussed with respect to FIG. 1). It should be appreciated that additional luminaires are envisioned.

As shown in FIG. 2, the electronic device 205 can connect (232) to luminaire A 211 and retrieve the MAC address (or other unique identifier) of luminaire A 211. According to embodiments, the electronic device 205 can connect to luminaire A 211 via any type of short range communication, as discussed herein. Further, the electronic device 205 can process (234) location data for luminaire A 211 by identifying its own location in proximity to luminaire A 211 (e.g., via GPS coordinates) and then associating its location as the location for luminaire A 211 (i.e., the electronic device 205 can associate its locations with the unique identifier for luminaire A 211). Additionally, the electronic device 205 can process (236) layout data for luminaire A 211 by associating the unique identifier and location for luminaire A 211 with a corresponding layout tag indicated in layout data for the lighting system. In operation, a user of the electronic device 205 can use a GUI to select which layout tag should be associated with luminaire A 211. In some embodiments, the electronic device 205 can generate a data record for luminaire A 211 that includes the MAC address (or other unique identifier) and the associated location, as well as the assigned layout tag from layout data.

The electronic device 205 can additionally connect (238) to luminaire B 212 and retrieve the MAC address (or other unique identifier) of luminaire B 212. According to embodiments, the electronic device 205 can connect to luminaire B 212 via any type of short range communication, as discussed herein. Further, the electronic device 205 can process (240) location data for luminaire B 212 by identifying its own location in proximity to luminaire B 212 (e.g., via GPS coordinates) and then associating its location as the location for luminaire B 212 (i.e., the electronic device 205 can associate its locations with the unique identifier for luminaire B 212). Additionally, the electronic device 205 can process (242) layout data for luminaire B 212 by associating the unique identifier and location for luminaire B 212 with a corresponding layout tag indicated in layout data for the lighting system. In operation, the user of the electronic device 205 can use a GUI to select which layout tag should be associated with luminaire B 212. In some embodiments, the electronic device 205 can generate a data record for luminaire B 212 that includes the MAC address (or other unique identifier) and the associated location, as well as the assigned layout tag from layout data.

The electronic device 205 can send (246) the processed or commissioning data including the MAC address, location data, and assigned layout tag for luminaire A 211 and luminaire B 212 to the remote server 220, for example via a network connection. As shown in FIG. 2, the remote server 220 can store (248) the processed data, for example in local storage such as a database. Accordingly, the remote server 220 can store the commissioning data associated with luminaire A 211 and luminaire B 212, as well as any other luminaire in the lighting system.

As shown in FIG. 2, the additional electronic device 225 can request (250) lighting system data from the remote server 220, such as via a network connection. For example, an administrator of the lighting system may want to retrieve layout data associated with the lighting system. The remote server 220 can provide (252) the lighting system data to the additional electronic device 225, where the additional electronic device 225 can display (254) any or all of the lighting system data, for example in a GUI. In some embodiments, a user of the additional electronic device 225 can filter or query the system data according to various techniques. In some optional embodiments, the electronic device 205 itself can request (256) lighting system data from the remote server 220, whereby the remote server 220 can provide (258) the lighting system data to the electronic device 205 which can display (260) any or all of the lighting system data.

Figure 3A:
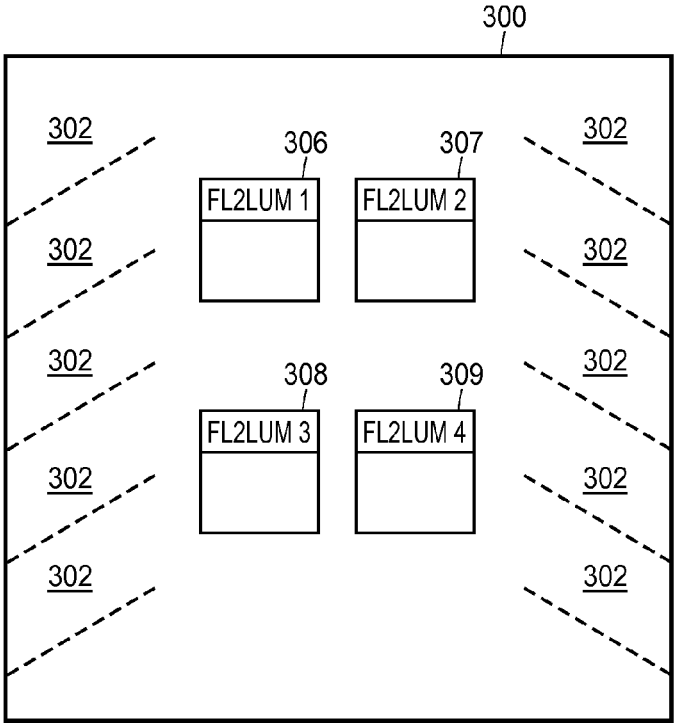
FIGS. 3A-3C depict example interfaces associated with commissioning a lighting system in accordance with some embodiments.
Figure 3B:
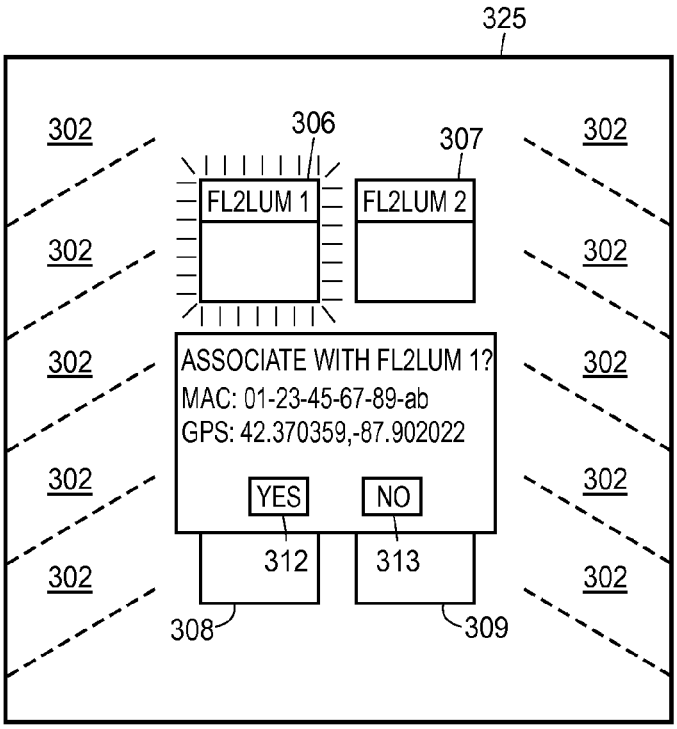
Figure 3C:
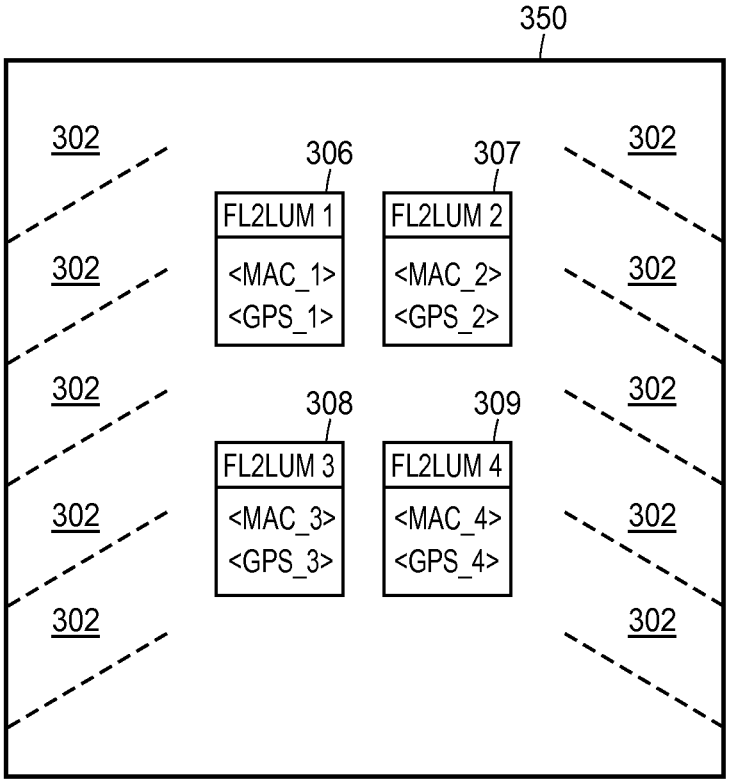

FIGS. 3A, 3B, and 3C depict example graphical layouts 300, 325, 350 of an example lighting system for an example parking garage. It should be appreciated that the graphical layouts 300, 325, 350 can be accessed via or displayable by any component associated with a lighting system, such as the electronic device 105, the server 120, the additional electronic device 125, or other component. The graphical layouts 300, 325, 350 of FIGS. 3A, 3B, and 3C all depict a section of a floor of the parking garage, with a plurality of parking spaces 302. It should be appreciated that the graphical layouts 300, 325, 350 can be predetermined or dynamically generated based on associated plans, layouts, or the like. For example, a designer of the parking garage can generate the graphical layouts 300, 325, 350 to match a planned lighting system and luminaires thereof.

As shown in FIG. 3A, the graphical layout 300 includes a set of layout tags 306, 307, 308, 309 associated with a corresponding set of luminaires installed (or to be installed) in the parking garage. In particular, the layout tag 306 corresponds to luminaire "FL2LUM1," the layout tag 307 corresponds to luminaire "FL2LUM2," the layout tag 308 corresponds to luminaire "FL2LUM3," and the layout tag 309 corresponds to luminaire "FL2LUM4." As shown in FIG. 3A, the layout tags 306, 307, 308, and 309 do not have associated location and identification data for the corresponding luminaires.

In an embodiment, an electronic device such as the electronic device 105 as described with respect to FIG. 1 can display (e.g., in a GUI) the graphical layout 300 to assist a user in commissioning a lighting system and the associated luminaires. When the electronic device retrieves a unique identifier for an installed luminaire and associates location data of the electronic device with the unique identifier, the user can select one of the layout tags 306, 307, 308, or 309 that corresponds to the installed luminaire. As an example, referring to FIG. 3B, the user selects the layout tag 306 corresponding to "FL2LUM1" after processing the location and identification data of the associated luminaire. The graphical layout 325 can display a window 311 that prompts a user to confirm the association of the unique identifier and location data for the luminaire with "FL2LUM1." If the user selects a "YES" selection 312, the electronic device can associate the location and identification data of the luminaire with "FL2LUM1," and if the user selects a "NO" selection 313, the electronic device can cancel the association and, for example, return to the graphical interface 300.

Referring to FIG. 3C, the graphical interface 350 depicts each of the layout tags 306, 307, 308, and 309 as including identification and location data for an associated luminaire and, according to embodiments, the lighting system of the parking garage can be deemed to be commissioned. Accordingly, the electronic device can send the identification, location data, and layout tag data for the luminaires to a server for storage and subsequent access.

Figure 4:
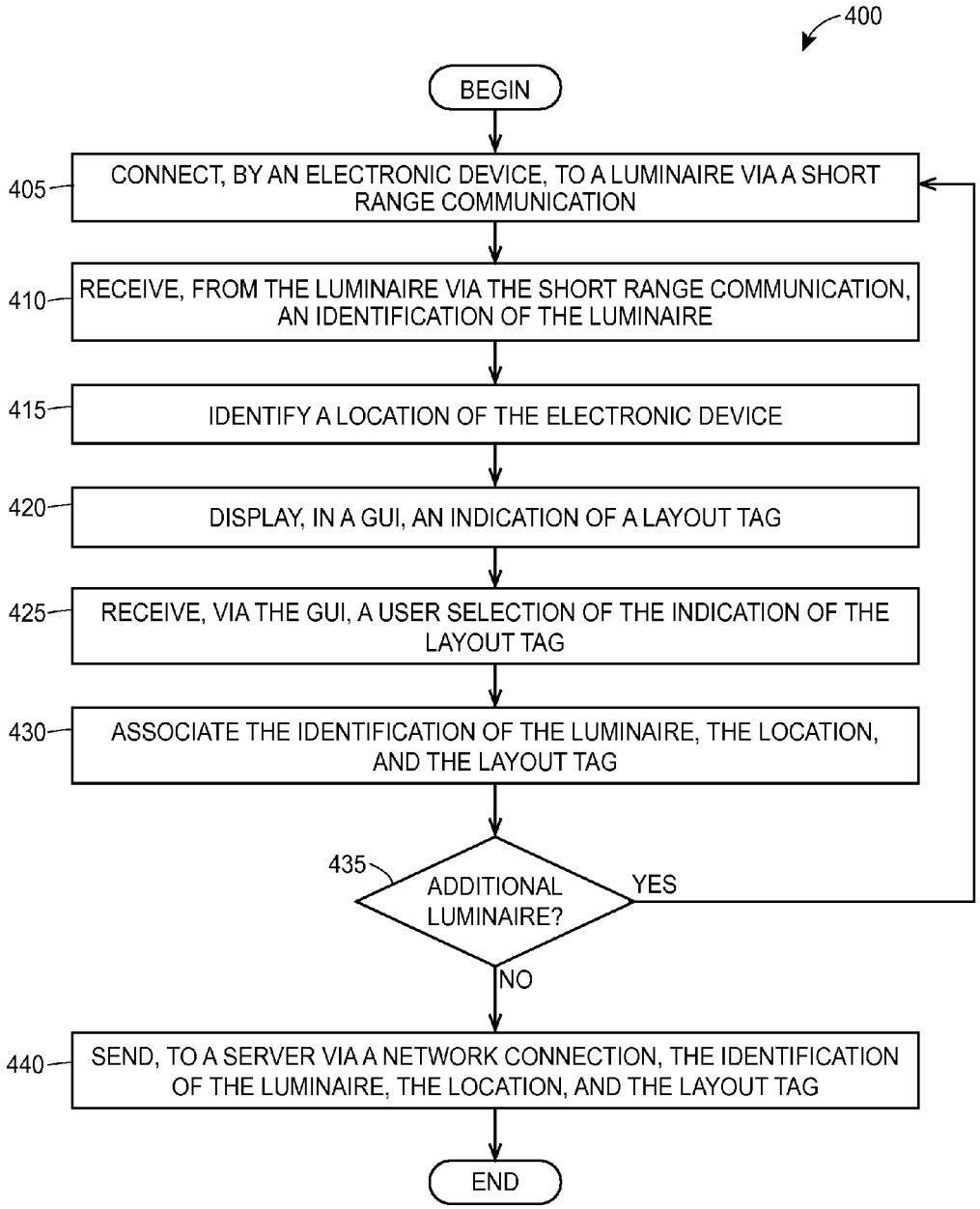
FIG. 4 depicts a flow diagram of using an electronic device to commission a lighting system in accordance with some embodiments.

FIG. 4 is a flowchart of a method 400 for an electronic device (such as the electronic device 105 as described with respect to FIG. 1) to commission a lighting system. The method 400 begins with the electronic device connecting (block 405) to a luminaire via a short range communication. In embodiments, the short range communication can be RFID, Bluetooth®, BLE, IrDA, NFC, ZigBee, other protocols defined under the IEEE 802 standard, and/or other technologies. The electronic device can receive (block 410), from the luminaire via the short range communication, an identification of the luminaire. For example, the identification of the luminaire may be a MAC address of the luminaire.

The electronic device can identify (block 415) its location. In some embodiments, the electronic device can identify its location using GPS coordinates received via a GPS receiver. The electronic device can display (block 420), in a GUI, an indication of a layout tag. In some cases, the electronic device can locally store layout information associated with the lighting system that includes the layout tag and one or more additional layout tags. In other cases, the electronic device can connect to a server (such as the remote server 120 as discussed with respect to FIG. 1) to retrieve layout data and then display the layout data in the GUI. The electronic device can receive (block 425), via the GUI, a user selection of the indication of the layout tag. In operation, a user of the electronic device can manually gauge the appropriate layout tag to select based on the corresponding luminaire for which the identification and location have been received and/or identified.

The electronic device can associate (block 430) the identification of the luminaire, the location, and the layout tag. In some embodiments, the electronic device can generate a data record (or other form of data or information) for the luminaire that includes the identification of the luminaire, the location, and the layout tag. The electronic device can further detect (block 435) if there is an additional luminaire to commission as part of the lighting system. In some cases, the user of the electronic device can select a function to toggle to an additional luminaire indicated in the layout data (or can select that there are no additional luminaires). In other cases, the electronic device can initiate a connection to the additional luminaire. If there is an additional luminaire ("YES"), processing can return to 405 and repeat the processing of 405, 410, 415, 420, 425, and 430 for the additional luminaire, or can proceed to other functionality. If there is not an additional luminaire ("NO"), processing can proceed to block 440 or to other functionality. At block 440, the electronic device can send, to a server via a network connection, the identification of the luminaire, the location, and the layout tag. According to embodiments, the server can store the received data for later retrieval by the electronic device and/or an additional electronic device.

Figure 5:
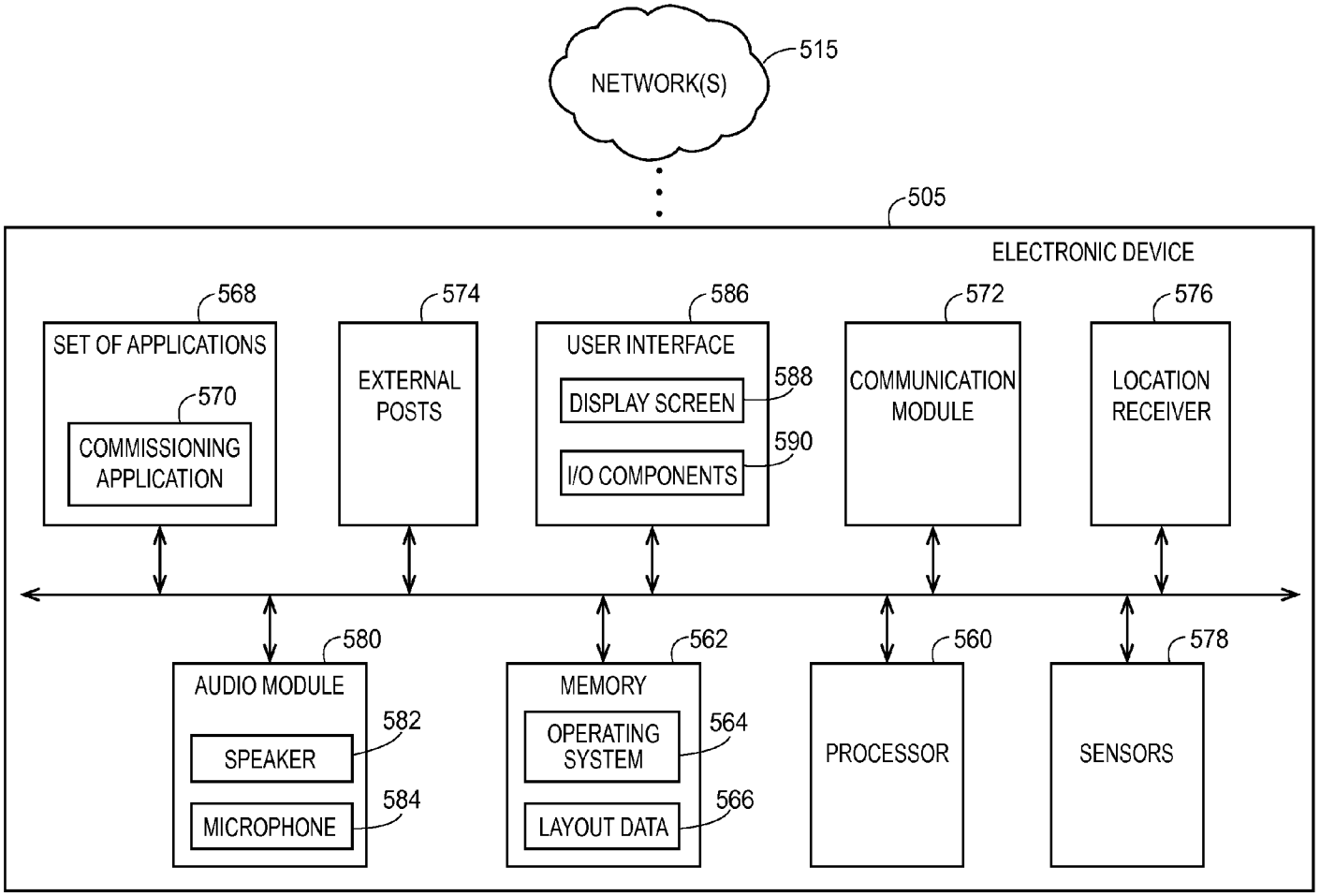
FIG. 5 is a block diagram of an electronic device in accordance with some embodiments.

FIG. 5 illustrates an example electronic device 505 in which the functionalities as discussed herein may be implemented. The electronic device 505 can include a processor 560 or other similar type of controller module or microcontroller, as well as a memory 562. The memory 562 can store an operating system 564 capable of facilitating the functionalities as discussed herein as well as layout data 566 corresponding to any locally-stored layout data and layout tags associated with one or more lighting systems. The processor 560 can interface with the memory 562 to execute the operating system 564 and retrieve the layout data 566, as well as execute a set of applications 568 such as a commissioning application 570 (which the memory 562 can also store). The memory 562 can include one or more forms of volatile and/or non-volatile, fixed and/or removable memory, such as read-only memory (ROM), electronic programmable read-only memory (EPROM), random access memory (RAM), erasable electronic programmable read-only memory (EEPROM), and/or other hard drives, flash memory, MicroSD cards, and others.

The electronic device 505 can further include a communication module 572 configured to interface with one or more external ports 574 to communicate data via one or more networks 515. For example, the communication module 572 can leverage the external ports 574 to establish a BLE connection for connecting the electronic device 505 to other devices such as one or more luminaires. According to some embodiments, the communication module 572 can include one or more transceivers functioning in accordance with IEEE standards, 3GPP standards, or other standards, and configured to receive and transmit data via the one or more external ports 574. More particularly, the communication module 572 can include one or more WWAN transceivers configured to communicate with a wide area network including one or more cell sites or base stations to communicatively connect the electronic device 505 to additional devices or components. For example, the transceiver can send commissioning data of a lighting system to a remote server via the network 515. Further, the communication module 572 can include one or more WLAN and/or WPAN transceivers configured to connect the electronic device 505 to local area networks and/or personal area networks. In embodiments, the communication module 572 can include components that enable short range communication with other devices (e.g., luminaires), such as RFID components, NFC components, Bluetooth® components, and/or the like. The electronic device 505 can further include a location receiver 576, for example a GPS receiver, that is configured to retrieve location coordinates or data.

The electronic device 505 can further include one or more sensors 578 such as, for example, imaging sensors, accelerometers, touch sensors, and other sensors. The electronic device 505 can include an audio module 580 including hardware components such as a speaker 582 for outputting audio and a microphone 584 for detecting or receiving audio. The electronic device 505 may further include a user interface 586 for presenting information to the user and/or receiving inputs from the user. As shown in FIG. 5, the user interface 586 includes a display screen 588 and I/O components 590 (e.g., capacitive or resistive touch sensitive input panels, keys, buttons, lights, LEDs, cursor control devices, haptic devices, and others). In embodiments, the display screen 588 is a touchscreen display using singular or combinations of display technologies and can include a thin, transparent touch sensor component superimposed upon a display section that is viewable by a user. For example, such displays include capacitive displays, resistive displays, surface acoustic wave (SAW) displays, optical imaging displays, and the like.

In general, a computer program product in accordance with an embodiment includes a computer usable storage medium (e.g., standard random access memory (RAM), an optical disc, a universal serial bus (USB) drive, or the like) having computer-readable program code embodied therein, wherein the computer-readable program code is adapted to be executed by the processor 560 (e.g., working in connection with the operating system 564) to facilitate the functions as described herein. In this regard, the program code may be implemented in any desired language, and may be implemented as machine code, assembly code, byte code, interpretable source code or the like (e.g., via C, C++, Java, Actionscript, Objective-C, Javascript, CSS, XML, and/or others).

Thus, it should be clear from the preceding disclosure that the systems and methods offer improved lighting system commissioning techniques. The embodiments advantageously enable remote and secure storage of commissioning data that is easily accessible via multiple different channels. The embodiments improve commissioning techniques by effectively and efficiently associating relevant data with specific luminaires. Further, the embodiments reduce hardware costs associated with the manufacture of luminaires.

Throughout this specification, plural instances may implement components, operations, or structures described as a single instance. Although individual operations of one or more methods are illustrated and described as separate operations, one or more of the individual operations may be performed concurrently, and nothing requires that the operations be performed in the order illustrated. Structures and functionality presented as separate components in example configurations may be implemented as a combined structure or component. Similarly, structures and functionality presented as a single component may be implemented as separate components. These and other variations, modifications, additions, and improvements fall within the scope of the subject matter herein.

Additionally, certain embodiments are described herein as including logic or a number of routines, subroutines, applications, or instructions. These may constitute either software (e.g., code embodied on a non-transitory, machine-readable medium) or hardware. In hardware, the routines, etc., are tangible units capable of performing certain operations and may be configured or arranged in a certain manner. In example embodiments, one or more computer systems (e.g., a stand alone, client or server computer system) or one or more hardware modules of a computer system (e.g., a processor or a group of processors) may be configured by software (e.g., an application or application portion) as a hardware module that operates to perform certain operations as described herein.

In various embodiments, a hardware module may be implemented mechanically or electronically. For example, a hardware module may comprise dedicated circuitry or logic that is permanently configured (e.g., as a special-purpose processor, such as a field programmable gate array (FPGA) or an application-specific integrated circuit (ASIC)) to perform certain operations. A hardware module may also comprise programmable logic or circuitry (e.g., as encompassed within a general-purpose processor or other programmable processor) that is temporarily configured by software to perform certain operations. It will be appreciated that the decision to implement a hardware module mechanically, in dedicated and permanently configured circuitry, or in temporarily configured circuitry (e.g., configured by software) may be driven by cost and time considerations.

Accordingly, the term "hardware module" should be understood to encompass a tangible entity, be that an entity that is physically constructed, permanently configured (e.g., hardwired), or temporarily configured (e.g., programmed) to operate in a certain manner or to perform certain operations described herein. Considering embodiments in which hardware modules are temporarily configured (e.g., programmed), each of the hardware modules need not be configured or instantiated at any one instance in time. For example, where the hardware modules comprise a general-purpose processor configured using software, the general-purpose processor may be configured as respective different hardware modules at different times. Software may accordingly configure a processor, for example, to constitute a particular hardware module at one instance of time and to constitute a different hardware module at a different instance of time.

Hardware modules can provide information to, and receive information from, other hardware modules. Accordingly, the described hardware modules may be regarded as being communicatively coupled. Where multiple of such hardware modules exist contemporaneously, communications may be achieved through signal transmission (e.g., over appropriate circuits and buses) that connect the hardware modules. In embodiments in which multiple hardware modules are configured or instantiated at different times, communications between such hardware modules may be achieved, for example, through the storage and retrieval of information in memory structures to which the multiple hardware modules have access. For example, one hardware module may perform an operation and store the output of that operation in a memory device to which it is communicatively coupled. A further hardware module may then, at a later time, access the memory device to retrieve and process the stored output. Hardware modules may also initiate communications with input or output devices, and can operate on a resource (e.g., a collection of information).

The various operations of example methods described herein may be performed, at least partially, by one or more processors that are temporarily configured (e.g., by software) or permanently configured to perform the relevant operations. Whether temporarily or permanently configured, such processors may constitute processor-implemented modules that operate to perform one or more operations or functions. The modules referred to herein may, in some example embodiments, comprise processor-implemented modules.

Similarly, the methods or routines described herein may be at least partially processor-implemented. For example, at least some of the operations of a method may be performed by one or more processors or processor-implemented hardware modules. The performance of certain operations may be distributed among the one or more processors, not only residing within a single machine, but deployed across a number of machines. In some example embodiments, the processor or processors may be located in a single location (e.g., within a home environment, an office environment or as a server farm), while in other embodiments the processors may be distributed across a number of locations.

The performance of certain operations may be distributed among the one or more processors, not only residing within a single machine, but deployed across a number of machines. In some example embodiments, the one or more processors or processor-implemented modules may be located in a single geographic location (e.g., within a home environment, an office environment, or a server farm). In other example embodiments, the one or more processors or processor-implemented modules may be distributed across a number of geographic locations.

Unless specifically stated otherwise, discussions herein using words such as "processing," "computing," "calculating," "determining," "presenting," "displaying," or the like may refer to actions or processes of a machine (e.g., a computer) that manipulates or transforms data represented as physical (e.g., electronic, magnetic, or optical) quantities within one or more memories (e.g., volatile memory, non-volatile memory, or a combination thereof), registers, or other machine components that receive, store, transmit, or display information.

As used herein any reference to "one embodiment" or "an embodiment" means that a particular element, feature, structure, or characteristic described in connection with the embodiment is included in at least one embodiment. The appearances of the phrase "in one embodiment" in various places in the specification are not necessarily all referring to the same embodiment.

Some embodiments may be described using the expression "coupled" and "connected" along with their derivatives. For example, some embodiments may be described using the term "coupled" to indicate that two or more elements are in direct physical or electrical contact. The term "coupled," however, may also mean that two or more elements are not in direct contact with each other, but yet still cooperate or interact with each other. The embodiments are not limited in this context.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

In addition, use of the "a" or "an" are employed to describe elements and components of the embodiments herein. This is done merely for convenience and to give a general sense of the description. This description, and the claims that follow, should be read to include one or at least one and the singular also includes the plural unless it is obvious that it is meant otherwise.

This detailed description is to be construed as examples and does not describe every possible embodiment, as describing every possible embodiment would be impractical, if not impossible. One could implement numerous alternate embodiments, using either current technology or technology developed after the filing date of this application.

The invention claimed is:

1. A method in a wireless communication device of commissioning a lighting system, the method comprising:

directly connecting, by the wireless communication device, to a luminaire via a short range communication;

upon directly connecting to the luminaire, receiving, by the wireless communication device directly from the luminaire via the short range communication, an identification of the luminaire;

identifying a location of the wireless communication device;

displaying, in a graphical user interface (GUI) of the wireless communication device, an indication of a layout tag corresponding to the luminaire;

receiving, via the GUI, a first user selection of the layout tag;

responsive to receiving the first user selection, displaying, in the GUI concurrently with displaying the indication of the layout tag, a window that (i) prompts a user to confirm luminaire association, and (ii) indicates the location of the wireless communication device;

receiving, via the window displayed in the GUI, a second user selection to associate the identification of the luminaire and the location of the wireless communication device with luminaire;

responsive to receiving the second user selection, generating, by a processor of the wireless communication device, a data record for the luminaire, the data record including the identification of the luminaire and the location of the wireless communication device; and sending, by the wireless communication device, the data record to a server via a network connection.

2. The method of claim 1, wherein generating the data record comprises generating the data record further including the layout tag corresponding to the luminaire.

3. The method of claim 1, further comprising:

connecting to an additional luminaire using the wireless communication device;

receiving, from the additional luminaire, an identification of the additional luminaire;

identifying an additional location of the wireless communication device;

generating an additional data record for the additional luminaire, the additional data record including the identification of the additional luminaire and the additional location of the wireless communication device; and sending the additional data record to the server via the network connection.

4. The method of claim 3, wherein the data record and the additional data record are concurrently sent to the server via the network connection.

5. The method of claim 1, wherein identifying the location of the wireless communication device comprises identifying, using a global positioning system (GPS) receiver of the wireless communication device, a GPS location of the wireless communication device.

6. The method of claim 1, wherein receiving the identification of the luminaire comprises:

receiving a media access control (MAC) address.

7. A wireless communication device for commissioning a lighting system, comprising:

a transceiver;

a user interface configured to display content;

a memory for storing a set of non-transitory computer-readable instructions; and a processor coupled to the transceiver and the memory, and configured to execute the set of non-transitory computer-readable instructions to:

directly connect, by the wireless communication device, to a luminaire via a short range communication, upon directly connecting to the luminaire, receive, by the wireless communication device, directly from the luminaire via the short range communication, an identification of the luminaire, identify a location of the wireless communication device, cause the user interface to display an indication of a layout tag corresponding to the luminaire, receive, via the user interface, a first user selection of the layout tag, responsive to receiving the first user selection, cause the user interface to display, concurrently with displaying the indication of the layout tag, a window (i) that prompts a user to confirm luminaire association, and (ii) indicates the location of the wireless communication device, receive, via the window displayed in the user interface, a second user selection to associate the identification of the luminaire and the location of the wireless communication device with the luminaire, responsive to receiving the second user selection, generate a data record for the luminaire, the data record including the identification of the luminaire and the location of the wireless communication device, and send, by the wireless communication device to a server using the transceiver, the data record.

8. The wireless communication device of claim 7, wherein the processor is further configured to execute the set of non-transitory computer-readable instructions to:

generate the data record further including the layout tag corresponding to the luminaire, and send, to the server using the transceiver, the data record further including the layout tag.

9. The wireless communication device of claim 7, wherein the processor is further configured to execute the set of non-transitory computer-readable instructions to:

connect to an additional luminaire, receive from the additional luminaire, an identification of the additional luminaire, identify an additional location of the wireless communication device, generate an additional data record for the additional luminaire, the additional data record including the identification of the additional luminaire and the additional location of the wireless communication device, and send, to the server using the transceiver, the additional data record.

10. The wireless communication device of claim 9, wherein the data record and the additional data record are concurrently sent to the server using the transceiver.

11. The wireless communication device of claim 7, further comprising a global positioning system (GPS) receiver, wherein the processor is further configured to execute the set of non-transitory computer-readable instructions to identify, using the GPS receiver, a GPS location of the wireless communication device.

12. The wireless communication device of claim 7, wherein the identification of the luminaire is a media access control (MAC) address.

* * * * *